US011761464B2

(12) United States Patent
Ziemens et al.

(10) Patent No.: US 11,761,464 B2
(45) Date of Patent: Sep. 19, 2023

(54) METHOD FOR CONTROLLING THE MOVEMENT OF A BOOM, AND WORK MACHINE

(71) Applicant: Putzmeister Engineering GmbH, Aichtal (DE)

(72) Inventors: Christian Ziemens, Stuttgart (DE); Francisco Martin Brugue, Darmstadt (DE)

(73) Assignee: Putzmeister Engineering GmbH, Aichtal (DE)

( * ) Notice: Subject to any disclaimer, the term of this patent is extended or adjusted under 35 U.S.C. 154(b) by 348 days.

(21) Appl. No.: 17/050,229

(22) PCT Filed: Apr. 17, 2019

(86) PCT No.: PCT/EP2019/059974

§ 371 (c)(1),
(2) Date: Oct. 23, 2020

(87) PCT Pub. No.: WO2019/206774

PCT Pub. Date: Oct. 31, 2019

(65) Prior Publication Data

US 2021/0231140 A1 Jul. 29, 2021

(30) Foreign Application Priority Data

Apr. 24, 2018 (DE) ..... 10 2018 206 271.4

(51) Int. Cl.
*F15B 11/16* (2006.01)
*F15B 21/02* (2006.01)
(Continued)

(52) U.S. Cl.
CPC ..... *F15B 21/02* (2013.01); *E04G 21/0463* (2013.01); *F15B 11/165* (2013.01);
(Continued)

(58) Field of Classification Search
CPC ..... F15B 11/161; F15B 11/165; F15B 2211/6309; F15B 2211/6313; F15B 2211/6323; F15B 2211/6346
See application file for complete search history.

(56) References Cited

U.S. PATENT DOCUMENTS 6,308,516 B1 * 10/2001 Kamada ..... F15B 11/165 60/452
7,434,393 B2 * 10/2008 Hesse ..... F15B 21/087 60/484
(Continued)

FOREIGN PATENT DOCUMENTS

DE 103 40 993 A1 3/2005
DE 10 2005 035 981 A1 2/2007
(Continued)

OTHER PUBLICATIONS

International Search Report (PCT/ISA/210) issued in PCT Application No. PCT/EP2019/059974 dated Jul. 22, 2019 with English translation (six (6) pages).
(Continued)

*Primary Examiner* — Michael Leslie
(74) *Attorney, Agent, or Firm* — Crowell & Moring LLP

(57) ABSTRACT

A method controls the movement of a boom, wherein the boom is moved by a plurality of hydraulic drives. Each hydraulic drive is fed with a hydraulic medium, the pressure and/or volume flow of which is adjustable. The method predefines a desired direction of movement and a desired speed of a boom tip; predictively calculates a pressure and/or a volume flow required for each of the hydraulic drives that are required for the desired direction of movement and desired speed; subsequently generates a supply pressure depending on the predictively calculated pressures and/or subsequently generating a supply volume flow as a function of the predictively calculated volume flows; and
(Continued)

subsequently feeds the hydraulic drives required for the desired direction of movement and desired speed with the hydraulic medium having a respective feed pressure and/or a respective feed volume flow such that the boom tip moves in the desired direction of movement at the desired speed.

8 Claims, 2 Drawing Sheets

(51) Int. Cl.

| | |
|---|---|
| ***E04G 21/04*** | (2006.01) |
| *B66C 13/20* | (2006.01) |
| *B66C 23/00* | (2006.01) |
| *B66F 11/04* | (2006.01) |
| *B66F 13/00* | (2006.01) |

(52) U.S. Cl.

CPC ..... *B66C 13/20* (2013.01); *B66C 23/54* (2013.01); *B66F 11/044* (2013.01); *B66F 13/00* (2013.01); *F15B 2211/20546* (2013.01); *F15B 2211/30535* (2013.01); *F15B 2211/6309* (2013.01); *F15B 2211/6313* (2013.01); *F15B 2211/6653* (2013.01); *F15B 2211/6654* (2013.01); *F15B 2211/71* (2013.01); *F15B 2211/7107* (2013.01)

(56) References Cited

U.S. PATENT DOCUMENTS

| | | | | |
|---|---|---|---|---|
| 8,522,543 | B2 * | 9/2013 | Krajnik | E02F 9/2235 60/368 |
| 9,200,646 | B2 * | 12/2015 | Weickert | E02F 9/2228 |
| 11,143,211 | B1 * | 10/2021 | Pintore | E02F 9/2285 |
| 11,313,388 | B1 * | 4/2022 | Pintore | E02F 9/2235 |
| 11,434,936 | B2 * | 9/2022 | Ziemens | F15B 21/08 |
| 11,454,003 | B2 * | 9/2022 | Caldwell | E02F 9/2228 |
| 2002/0011013 | A1 | 1/2002 | Sawada et al. | |
| 2002/0073699 | A1 | 6/2002 | Nishimura et al. | |
| 2008/0016862 | A1 | 1/2008 | Von Baumen et al. | |
| 2008/0162005 | A1 | 7/2008 | Tang et al. | |
| 2009/0151346 | A1 | 6/2009 | Kim | |
| 2010/0115938 | A1 | 5/2010 | Kobata | |
| 2014/0069091 | A1 * | 3/2014 | Franzoni | F15B 13/022 60/429 |
| 2019/0119934 | A1 | 4/2019 | Vierkotten et al. | |

FOREIGN PATENT DOCUMENTS

| | | | | |
|---|---|---|---|---|
| DE | 102012110978 | A1 * | 5/2014 | F15B 11/161 |
| DE | 10 2015 201 318 | A1 | 8/2016 | |
| EP | 1 939 134 | A2 | 7/2008 | |
| EP | 2 072 691 | A1 | 6/2009 | |
| GB | 2460782 | A | 12/2009 | |
| JP | 61-134467 | A | 6/1986 | |
| JP | 62-244967 | A | 10/1987 | |
| JP | 2002-38533 | A | 2/2002 | |
| JP | 2002-179387 | A | 6/2002 | |
| JP | 2008-267460 | A | 11/2008 | |
| JP | 2009-503383 | A | 1/2009 | |
| JP | 2009-144505 | A | 7/2009 | |
| WO | WO 2017/178413 | A1 | 10/2017 | |

OTHER PUBLICATIONS

German-language Written Opinion (PCT/ISA/237) issued in PCT Application No. PCT/EP2019/059974 dated Jul. 22, 2019 (six (6) pages).

German-language Office Action issued in German Application No. 10 2018 206 271.4 dated Jan. 3, 2019 (five (5) pages).

Japanese-language Office Action issued in Japanese Application No. 2020-559407 dated May 9, 2023 with English translation (11 pages).

* cited by examiner

METHOD FOR CONTROLLING THE MOVEMENT OF A BOOM, AND WORK MACHINE

BACKGROUND AND SUMMARY OF THE INVENTION

The invention relates to a method for controlling the movement of a boom, and to a work machine with a boom.

The invention is based on the object of providing a method for controlling the movement of a boom, and a work machine with a boom, which enable as optimum a control operation of the movement of the boom as possible.

The invention achieves said object by way of a method for controlling the movement of a boom and by way of a work machine in accordance with the claimed invention.

The method according to the invention serves to control the movement of a boom. The boom is moved by means of a plurality of hydraulic drives, a respective hydraulic drive being fed with a hydraulic medium, for example hydraulic oil, the pressure of which and/or the volumetric flow of which can be set.

According to the invention, a desired movement direction and a desired speed of a boom tip are first of all specified, for example, by means of a suitable input device, for example in the form of a joystick, without this initially leading directly to a movement of the boom tip.

A respective required pressure and/or a respective required volumetric flow are/is then predictively calculated in advance for those hydraulic drives which are required for the desired movement direction and the desired speed. The required pressures and/or the required volumetric flows can be calculated in advance, for example, in a manner which is based on measured values of sensors which detect an instantaneous load of the overall boom, and in a manner which is based on a boom model.

Following the calculation in advance, a supply pressure is generated in a manner which is dependent on the predictively calculated pressures and/or a supply volumetric flow is generated in a manner which is dependent on the predictively calculated volumetric flows.

Subsequently, the hydraulic drives which are required for the desired movement direction and the desired speed are fed with the hydraulic medium at a respective feed pressure and/or a respective feed volumetric flow in such a way that the boom tip moves in the desired movement direction at the desired speed.

After the specified movement or part movement has taken place, for example, a regulation of the feed pressure can take place again by means of a conventional load sensing regulation operation. To this extent, reference is made, for example, to the disclosure of DE 10 2005 035 981 A1 which discloses a hydraulic circuit arrangement, on which the invention is based.

In accordance with one embodiment, a single supply line is loaded with the supply pressure and/or the supply volumetric flow is conducted in the supply line, a respective feed pressure being derived from the supply pressure and/or a respective feed volumetric flow being derived from the supply volumetric flow. Here, a single pump typically feeds a plurality of consumers.

In accordance with one embodiment, the generating of the supply pressure has the steps: determining of a highest load pressure under the respective predictively calculated pressures, and generating of the supply pressure in a manner which is dependent on the determined highest load pressure, for example in such a way that the supply pressure is greater than or equal to the determined highest load pressure.

In accordance with one embodiment, at least part of the hydraulic drives are hydraulic cylinders or boom cylinders. In addition, a hydraulic drive can form, for example, a hydraulic rotary drive.

In accordance with one embodiment, the supply pressure and/or the supply volumetric flow are/is generated by means of a single controllable hydraulic pump.

The work machine according to the invention is configured to carry out a method as claimed in one of the preceding claims.

The work machine conventionally has a boom with a plurality of boom segments or boom arms which can be moved relative to one another.

Furthermore, the work machine has a plurality of hydraulic drives which are configured to move the boom, a respective hydraulic drive being fed with a hydraulic medium, the pressure of which and/or the volumetric flow of which can be set.

The boom can be configured as a conventional so-called articulated boom, by means of which a reach and height difference between a vehicle which supports the boom and a concreting site can be set continuously. The articulated boom can have boom arms or boom segments which are connected to one another in an articulated manner and can be pivoted about axes which run parallel to one another and at a right angle with respect to a vertical axis of the boom. By means of the hydraulic drives, the boom or articulated boom can be unfurled at different distances and/or height differences between the concreting site and the vehicle location.

Furthermore, the work machine has a setting device, for example in the form of a joystick, by means of which a desired movement direction and a desired speed of a boom tip can be specified. For example, the joystick can be deflected in the desired movement direction, the extent of the deflection determining the desired movement speed.

Furthermore, the work machine has a computing unit, for example in the form of a processor and an associated program and main memory, which computing unit is configured to predictively calculate a respective required pressure and/or a respective required volumetric flow for those hydraulic drives which are required for the desired movement direction and the desired speed.

Furthermore, the work machine has a pressure generating device and/or a volumetric flow generating device which are/is configured, following the predictive calculating, to generate a supply pressure in a manner which is dependent on the predictively calculated pressures and/or to generate a supply volumetric flow in a manner which is dependent on the predictively calculated volumetric flows.

The required supply volumetric flow can be generated, for example, by way of suitable setting of a pivoting angle of a hydraulic pump, the suitable pivoting angle being calculated in a manner which is based on a motor rotational speed, a transmission ratio and a maximum displacement. For the brief duration, during which the supply volumetric flow is not yet required (before opening of the consumer valves), the excess volumetric flow typically flows away via a pressure relief valve of the pump.

The required supply pressure can be generated, for example, by means of a pressure regulator of a hydraulic pump by way of a corresponding setpoint value specification.

Furthermore, the work machine has a feed device which is configured to bring about subsequent feeding of the hydraulic drives which are required for the desired movement direction and the desired speed with the hydraulic medium at a respective feed pressure and/or a respective feed volumetric flow in such a way that the boom tip moves in the desired movement direction at the desired speed.

In accordance with one embodiment, the work machine is a mobile crane or an aerial work platform.

In accordance with one embodiment, the work machine is an auto concrete pump.

In the case of the operation of the boom in coupled operation of the hydraulic drives and a single hydraulic pump, hydraulic cylinders with a lower load react earlier than hydraulic cylinders with a higher load due to the required pressure build-up. As a result, the disadvantage arises for an operator that, for example, the trajectory of the boom tip becomes less precise or the boom can be caused to vibrate.

According to the invention, a movement of the hydraulic drives or the boom tip which is calculated in advance can be used to predictively adapt the pressure generating device or volumetric flow generating device, for example in the form of a boom pump, even just before a pressure requirement or volumetric flow requirement to the computationally detected requirement and, for example, to swivel out the boom pump as required. As a result, the preference of consumers which are subjected to low load is canceled, which, for a user, not only leads to an improvement in the trajectory, but also facilitates the setting of the regulating parameters in the case of the boom inspection.

By means of the invention, the increased pressure requirement and/or volumetric flow requirement can already be provided before feed valves of the hydraulic drives are opened, for example on the basis of a predictive pump regulation operation, as a result of which the systemic disadvantages of the delayed pressure build-up and the associated preference of consumers which are subjected to low load can be avoided.

BRIEF DESCRIPTION OF THE DRAWINGS

In the following text, the invention will be described in detail with reference to the drawings, in which, diagrammatically.

DETAILED DESCRIPTION OF THE DRAWINGS

Figure 1:
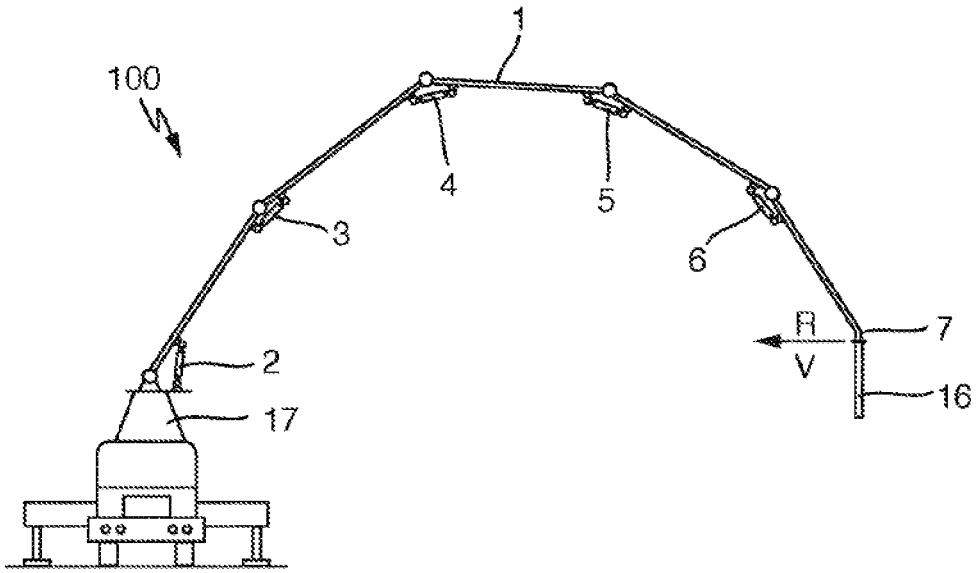
FIG. 1 shows a side view of a work machine in the form of an auto concrete pump with an articulated boom in a working position.

FIG. 1 shows a diagrammatic side view of a work machine 100 in the form of an auto concrete pump with an (articulated) boom 1 in a working position. The boom 1 conventionally forms a distributor boom for liquid concrete.

In a manner which is known per se, the boom 1 has five boom segments or boom arms which are connected to one another in an articulated manner and can be pivoted about axes which run parallel to one another and at a right angle with respect to a vertical axis of the boom 1. The boom 1 can be unfurled or folded up by means of hydraulic drives 2 to 6 in the form of hydraulic cylinders. Reference is also made to this extent to the relevant specialist literature.

The drawings show the hydraulic cylinders 2 to 6 as single-action hydraulic cylinders for the sake of simplicity. In practice, however, double-action hydraulic cylinders are typically used for the actuation of the boom arms.

In addition to the hydraulic drives 2 to 6, furthermore, a hydraulic rotary drive 17 is provided, by means of which the boom 1 can conventionally be rotated about a vertical axis.

The hydraulic drives 2 to 6 and 17 are conventionally fed with a hydraulic medium, the pressure of which and/or the volumetric flow of which can be set.

The boom 1 has a boom tip 7, on which an end hose 16 is arranged, from which liquid concrete can be discharged during operation. Reference is also made to this extent to the relevant specialist literature.

Figure 2:
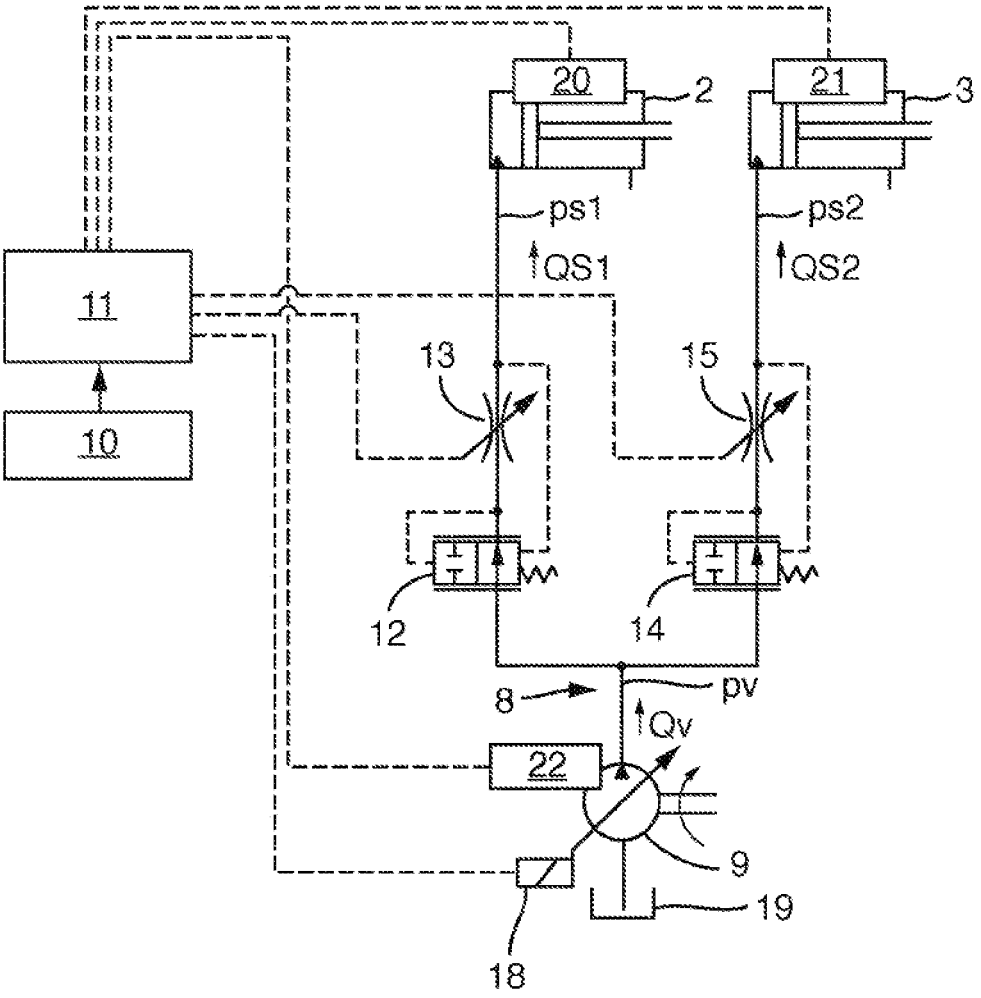
FIG. 2 shows a block circuit diagram of a controller, and a hydraulic circuit of the work machine which is shown in FIG. 1.

FIG. 2 diagrammatically shows a block circuit diagram of a controller, and a hydraulic circuit of the work machine 100 which is shown in FIG. 1.

For reasons of simpler illustration, merely the hydraulic drives 2 and 3 from FIG. 1 are shown as consumers by way of example in the hydraulic circuit. It goes without saying that the hydraulic drives 3 to 6 and 17 can be fed or are fed in a corresponding way.

Furthermore, there can be further components, for example consumer valves, pressure relief valves, etc. which, however, are not essential for the description of the principle of the invention. Reference is also made to this extent to the relevant specialist literature or prior art, for example in the form of DE 10 2005 035 981 A1.

The hydraulic circuit has a single pressure generating device or volumetric flow generating device 9 in the form of a motor-operated hydraulic pump 9 which conveys hydraulic oil from a tank 19 into a feed line or supply line 8. A pivotable adjusting member 18 is provided to set a volumetric flow which is conveyed into the supply line 8 by means of the hydraulic pump 9.

The supply line 8 branches into two feed lines to the hydraulic drives 2 and 3, a valve 12 and an actuable proportional valve 13 being arranged in the path between the hydraulic consumer 2 and the supply line 8, and a valve 14 and an actuable proportional valve 15 being arranged correspondingly in the path between the hydraulic consumer 3 and the supply line 8.

The valves 12 and 14 bring about that a pressure which drops at the proportional valves 13 and 15 is approximately constant, with the result that a volumetric flow through the proportional valves 13 and 15 is substantially dependent on the opening cross section of the proportional valves 13 and 15. The elements 12 to 15 form a feed device.

Pressure sensors 20 and 21 detect a hydraulic pressure in the hydraulic drives 2 and 3.

Furthermore, an optional pressure sensor 22 is provided which measures a supply pressure pV which is generated by means of the hydraulic pump 9.

The controller of the work machine has a computing unit 11. The computing unit 11 is connected to the pressure sensors 20, 21 and 22, and evaluates the sensor signals which are supplied by the pressure sensors 20, 21 and 22. The computing unit 11 actuates the proportional valves 13 and 15 and the adjusting member 18.

Furthermore, the controller of the work machine 100 has a setting device 10 which is operatively connected to the computing unit 11. The setting device 10 can be configured, for example, as a control lever which can be adjusted, for example, in three main actuating directions with the output of control signals to the computing unit 11. A desired movement direction R and a desired speed v of the boom tip 7 can be specified by means of the setting device 10.

According to the invention, the computing unit 11 is configured to predictively calculate a respective required pressure or pressure gradient and/or a respective required volumetric flow or volumetric flow gradient for those hydraulic drives 2 to 6 which are required for the desired movement direction R and the desired speed v.

After the predictive calculating of the pressure and/or the volumetric flow, the computing unit 11 actuates the adjusting member 18 in such a way that a supply pressure pV is generated suitably in a manner which is dependent on the predictively calculated pressures, and/or a supply volumetric flow QV is generated suitably in a manner which is dependent on the predictively calculated volumetric flows.

Subsequently, the computing unit actuates the proportional valves 13 and 15 in such a way that the hydraulic drives (here, 2 and 3 by way of example) which are required for the desired movement direction R and the desired speed v are supplied with the hydraulic medium at a respective feed pressure pS1 and pS2, respectively, and/or a respective feed volumetric flow QS1 and QS2, respectively, in such a way that the boom tip 7 moves in the desired movement direction R at the desired speed v.

In the case of the determining of the necessary supply pressure pV in the computing unit 11, a highest load pressure under the respective predictively calculated pressures can be determined, the supply pressure pV being generated in a manner which is dependent on the determined highest load pressure.

What is claimed is:

1. A method for controlling movement of a boom, the boom being moved by way of a plurality of hydraulic drives, a respective hydraulic drive being fed with a hydraulic medium, a pressure of which and/or a volumetric flow of which is settable, the method comprising the steps of:

specifying a desired movement direction and a desired speed of a boom tip;

predictively calculating a respective required pressure and/or a respective required volumetric flow for one or more hydraulic drives which are required for the desired movement direction and the desired speed based on measured values of sensors which detect an instantaneous load of the boom and based on a boom model;

subsequently generating a supply pressure in a manner which is dependent on the predictively calculated pressures and/or subsequently generating a supply volumetric flow in a manner which is dependent on the predictively calculated volumetric flows; and subsequently feeding the one or more hydraulic drives which are required for the desired movement direction and the desired speed with the hydraulic medium at a respective feed pressure and/or a respective feed volumetric flow such that the boom tip moves in the desired movement direction at the desired speed.

2. The method as claimed in claim 1, wherein a supply line is loaded with the supply pressure and/or the supply volumetric flow is conducted in the supply line, and a respective feed pressure is derived from the supply pressure and/or a respective feed volumetric flow is derived from the supply volumetric flow.

3. The method as claimed in claim 1, wherein the generating of the supply pressure comprises the steps of:

determining a highest load pressure under the respective predictively calculated pressures, and generating the supply pressure in a manner which is dependent on the determined highest load pressure.

4. The method as claimed in claim 1, wherein at least part of the hydraulic drives are hydraulic cylinders.

5. The method as claimed in claim 1, wherein the supply pressure and/or the supply volumetric flow are generated by a single hydraulic pump.

6. A work machine, comprising:

a boom;

a plurality of hydraulic drives which are configured to move the boom, a respective hydraulic drive being fed with a hydraulic medium, the pressure of which and/or the volumetric flow of which is settable;

a setting device, by which a desired movement direction and a desired speed of a boom tip is specified, a computing unit which is configured to predictively calculate a respective required pressure and/or a respective required volumetric flow for one or more hydraulic drives which are required for the desired movement direction and the desired speed based on measured values of sensors which detect an instantaneous load of the boom and based on a boom model;

a pressure generating device and/or a volumetric flow generating device configured, following the predictive calculating, to generate a supply pressure in a manner dependent on the predictively calculated pressures and/or a supply volumetric flow in a manner dependent on the predictively calculated volumetric flows; and a feed device configured to bring about subsequent feeding of the one or more hydraulic drives which are required for the desired movement direction and the desired speed with the hydraulic medium at a respective feed pressure and/or a respective feed volumetric flow such that the boom tip moves in the desired movement direction at the desired speed.

7. The work machine as claimed in claim 6, wherein the work machine is a mobile crane or an aerial work platform.

8. The work machine as claimed in claim 6, wherein the work machine is an auto concrete pump.

* * * * *